United States Patent [19]

Schilling et al.

[11] Patent Number: 4,959,249

[45] Date of Patent: Sep. 25, 1990

[54] SELF-CROSSLINKING VINYL ESTER DISPERSIONS HAVING A REDUCED FORMALDEHYDE CONTENT OR CONTAINING NO FORMALDEHYDE FOR STRENGTHENING TEXTILE FIBER STRUCTURES

[76] Inventors: Bernd Schilling, Schopenhauerweg 10; Gerhard Brink, Inden Gruben Nr. 131/32, both of 8263 Burghausen; Ingo Harder, Kollmunzerstrasse 21a, 8261 Mehring/Od; Hubert Wiest, Wettersteinstrasse 26, 8023 Pullach, all of Fed. Rep. of Germany

[21] Appl. No.: 423,002

[22] Filed: Oct. 18, 1989

Related U.S. Application Data

[62] Division of Ser. No. 221,729, Jul. 20, 1988, abandoned.

[30] Foreign Application Priority Data

Aug. 14, 1987 [DE] Fed. Rep. of Germany ..... 3727181

[51] Int. Cl.[5] ..... C08F 218/08; C08F 130/08; C08G 77/20; C09D 143/04

[52] U.S. Cl. ..... 427/387; 524/806; 428/266; 428/274

[58] Field of Search ..... 427/387; 428/266, 274; 524/806

[56] References Cited

U.S. PATENT DOCUMENTS

| | | | |
|---|---|---|---|
| 3,729,438 | 4/1973 | Plesich | 260/29.6 R |
| 3,814,716 | 6/1974 | Kowalski | 260/29.6 T |
| 4,720,520 | 1/1988 | Huhn | 427/387 |

*Primary Examiner*—C. Warren Ivy
*Attorney, Agent, or Firm*—Burgess, Ryan & Wayne

[57] ABSTRACT

Binders for strengthening textile fiber structures and based on aqueous, self-crosslinking vinyl ester dispersions having a reduced formaldehyde content or containing no formaldehyde. The low content of free formaldehyde in the dispersion is achieved by partial or complete substitution of the crosslinking comonomers containing N-methylol groups by vinylalkoxysilanes as crosslinking agents. Non-woven treated with these formaldehyde-free or low formaldehyde binder systems are distinguished by high strength values and excellent solvent resistance.

4 Claims, No Drawings

SELF-CROSSLINKING VINYL ESTER DISPERSIONS HAVING A REDUCED FORMALDEHYDE CONTENT OR CONTAINING NO FORMALDEHYDE FOR STRENGTHENING TEXTILE FIBER STRUCTURES

This is a division of application Ser. No. 221,729, filed Jul. 20, 1988, now abandoned.

The invention relates to self-crosslinking vinyl ester dispersions which contain, as crosslinking components, silanolalkoxy- and/or silanoloxy-functional comonomers, if appropriate, in combination with ethylenically unsaturated N-methylolamide and/or N-methylolether amide comonomers.

BACKGROUND OF THE INVENTION

The use of self-crosslinking vinyl ester dispersions in the production of non-wovens is known. Self-crosslinking polymeric binders increase the wet and dry strength on mechanical load and improve the resistance to water and solvents during cleaning. The crosslinking agents employed in practice are predominantly monomers containing N-methylol groups, such as N-methylol drivatives of unsaturated organic acid amides (N-methylolacrylamide) or ethers thereof (N-(iso-butoxyumethyl)-acrylamide). When these compounds are used as crosslinking agents, free methylol groups are present in the dispersion or are formed by hydrolysis of the derivatives in aqueous medium. Formaldehyde is eliminated from N-methylol compounds in aqueous media, but the equilibrium is far over towards the intact methylol group. Aqueous dispersions of self-crosslinking copolymers containing N-methylol groups, therefore, always contain formaldehyde, even if in only small amounts. As a consequence of the toxicological doubts regarding formaldehyde, which have been discussed for some time, and the regulation that only formaldehyde-free plastic dispersion systems may be used for non-wovens in the sanitary and hygiene areas, there is a necessity to reduce the formaldehyde content in self-crosslinking polymer dispersions or to make available formaldehyde-free self-crosslinking polymer dispersions.

Various ways of reducing the formaldehyde content or preparing formaldehyde-free binders for non-wovens are known from the specialized literature.

DE-Al 3,202,122 (U.S.A. 4,476,182) describes formaldehyde-free acrylate dispersions having hydroxyl and carboxyl groups. Although the fiber non-wovens strengthened using these systems have good mechanical values, the resistance towards organic solvents is, however, not sufficient, meaning the crosslinking agents, such as, for example, glyoxal, must be added in order to achieve good stability during cleaning.

In DE-Al 3,328,456 (EP-Al 143,175), formaldehyde-free, crosslinking polymer systems containing crosslinking components based on N-methylolamide and/or N-methylolether amide groups are claimed. The formaldehyde reduction is achieved here by adding a formaldehyde acceptor based on cyclic ureas, such as, for example, ethyleneurea, which bonds the free formaldehyde produced. The disadvantage of this procedure is that the wet strength values, in particular, of the bound non-wovens are reduced by adding water-soluble organic substances, and formaldehyde is still present, although in bound form, and may be liberated, for example, on heating.

A route which is analogous to DE-Al 3,328,456 and has the abovementioned disadvantages is used in EP-Bl 80,635. Here, urea as formaldehyde scavenger is added to the dispersion.

A further process for reducing the content of the free formaldehyde in the binder dispersion is claimed in EP-A3 121,864 (USA 4,449,978). Here, the formaldehyde emission is reduced by replacing N-methylolacrylamide units by acrylamide units. Formaldehyde-free dispersions cannot be obtained using this procedure, but above all, the strength properties and the resistance during cleaning of the non-wovens treated with this binder are greatly reduced.

Formaldehyde-free acrylate dispersions are claimed in EP-A2 193,107. Derivatives of acrylamidoglycolic acid as crosslinking components are copolymerized here with (meth)acrylates. Although the fiber non-wovens strengthened using these dispersions are distinguished by high wet strength and by high water and washing lye resistance, the resistance to organic solvents is, however, unsatisfactory—it is necessary to introduce additional crosslinking agents into the dispersion.

EP-A2 184,153 describes formaldehyde-free binders, for non-wovens, based on copolymers containing unsaturated dicarboxylic acids and (meth)acrylamide as crosslinkable comonomers. Due to the absence of self-crosslinkability, the fiber non-wovens strengthened therewith have inadequate mechanical strength values and poor solvent resistance.

The processes described show that although it is, in priciple, possible to provide formaldehyde-free or formaldehyde-reduced binder systems for strengthening non-wovens, the strength values and, in particular, the solvent resistance, above all in the case of complete substitution, have not yet reached the level of binder systems containing N-methylol units.

The object was, therefore, to develop, as binders for non-wovens, crosslinkable, aqueous copolymer dispersions, above all containing vinyl esters having a greatly reduced content of free formaldehyde or containing no free formaldehyde and imparting good mechanical values and solvent resistances on the strengthened fiber non-wovens.

BRIEF DESCRIPTION OF THE INVENTION

Surprisingly, the object has been achieved in that the crosslinking monomers containing N-methylolamide or N-methylolether amide groups have been substituted, partially or completely, by monomers containing silanolalkoxy groups or silanoloxy groups.

The invention relates to the use of self-crosslinking vinyl ester dispersions having a reduced formaldehyde content or containing no formaldehyde for strengthening textile fiber structures and based on copolymers of the following compositions:

(a) 40–99% by weight of vinyl esters of branched or linear carboxylic acids having 1 to 12 carbon atoms, (b) 1–6% by weight of vinyltrialkoxysilanes and/or alkylvinyldialkoxysilanes containing branched or linear alkyl or alkoxy radicals having 1 to 4 carbon atoms, (c) 0–40% by weight of ethylene, (d) 0–10% by weight of ethylenically unsaturated, hydroxyalkyl-functional compounds, (e) 0–10% by weight of ethylenically unsaturated carboxylic acids, (f) 0–5% by weight of amides, N-alkylamides and/or N-alkoxyalkylamides of ethylenically unsaturated carboxylic acids, and (g) 0–1% by weight of ethylenically polyunsaturated compounds.

The amounts by weight are relative to the total weight of the copolymer, and the individual proportions add up to a total of 100% by weight.

DETAILED DESCRIPTION OF THE INVENTION

As component (a), vinyl acetate, vinyl propionate, vinyl isobutyrate, vinyl 2-ethylhexanoate, vinyl versatate and vinyl laurate, for example, preferably vinyl acetate, can be employed. Component (a) is preferably employed in an amount of 70 to 98% by weight for hard binder systems, and preferably in an amount of 40 to 80% by weight for soft binder systems.

Component (b), employed in amounts from 1–6% by weight, preferably contains methyl radicals as alkyl radicals, and methoxy, ethoxy, methoxyethylene, ethoxyethylene, methoxypropylene glycol ether or ethoxypropylene glycol ether radicals as alkoxy radicals. In particular, vinyl trimethoxysilane and vinyl triethoxysilane are used. Component (b) is preferably copolymerized in amounts from about 1–4% by weight.

Component (c), ethylene, is preferably employed in soft binder systems in amounts from about 5 to 35% by weight.

As component (d), hydroxyethyl acrylate, hydroxypropyl acrylate, hydroxypropyl methacrylate and hydroxymethacrylate are preferably employed. Component (d) is preferably copolymerized in amounts from about 0–7.5% by weight.

Component (e) preferably covers monocarboxylic acids, such as acrylic acid, methacrylic acid and crotonic acid, and ethylenically unsaturated dicarboxylic acids and monoesters thereof, such as maleic acid, fumaric acid and itaconic acid. The preferred content of (e) in the polymer is 0 to about 5% by weight.

As component (f), acrylamide, N-methylolacrylamide and N-(iso-butoxymethyl)acrylamide are preferred; (f) is preferably employed in amounts from about 0.5 to about 2.5% by weight. In particular formaldehyde-free polymer dispersions do not contain any compound (f).

As component (g), difunctional and trifunctional, unsaturated compounds, such as allyl methacrylate, divinyl adipate and triallyl cyanurate are preferably employed. Component (g) is preferably employed in amounts up to about 0.75% by weight.

In spite of the high reactivity of the silanoloxy or silanoalkoxy groups, the dispersions containing the copolymers according to the invention are coagulate-free and have a low degree of premature crosslinking and, accordingly, high stability on storage. Surprisingly, a very high degree of self-crosslinking, which even exceeds that of N-methylolamide-containing copolymers, is obtained when using vinyl silanes, which means that extremely high degrees of crosslinking and, accordingly, good values for mechanical strength and solvent resistance are obtained at significantly lower contents than when using N-methylolamide-containing comonomers. This is the decisive factor in making substantial or complete substitution of N-methylolamide-containing comonomers by vinyl silane units possible. A further advantage is the significantly milder crosslinking temperature of vinyl silanes compared with customary self-crosslinking comonomers; this temperature considerably reduces the thermal load during crosslinking and drying of the fiber non-wovens. Finally, due to the more advantageous copolymerization parameters of non-woven binders based on vinyl acetate, the polymerization can be carried out under significantly more economical conditions when N-methylolamide comonomers are substituted by vinyl silanes.

For the broad applicational spectrum of fiber non-wovens strengthened by crosslinking binder systems, various demands are placed on the hardness of the polymer systems, which is known to those skilled in the art under the term "hard and soft hand", and is directly related to the so-called glass-transition temperature of the base polymers used. Thus, hard polymer systems are desired, for example, for strengthening cotton non-wovens and polyester non-wovens for roof sheeting coatings, which can be achieved by using large amounts of vinyl acetate for the copolymers. Soft systems are desired for the production of non-wovens for the hygiene sector such as, for example, cleaning cloths and diapers, which can be achieved by using copolymer systems having glass-transition temperatures of 0° C. This is possible, for example, by using vinyl esters of carboxylic acids having more than four carbon atoms, such as vinyl versatate and vinyl laurate as the principal copolymer component or by copolymerization of ethylene with vinyl esters of carboxylic acids having less than four carbon atoms.

The vinyl ester copolymer dispersions claimed according to the invention can be prepared by customary methods of emulsion polymerization. The monomers may be introduced into the aqueous dispersant at the beginning of the polymerization, but they may alternatively be metered partially or completely during the polymerization. The dispersants used may be any emulsifiers and protective colloids conventionally used in emulsion polymerization. It is possible to use mixtures of protective colloids and emulsifiers, but protective colloids and emulsifiers may each be employed alone. Emulsifiers which can be employed are anionic, cationic and nonionic emulsifiers. The polymerization can be carried out in a temperature range from 0 to 100° C. using water-soluble free-radical forming catalysts which are customary in emulsion polymerization, if appropriate, together with reducing agents. The solids content of the dispersions is 45 to 60% by weight.

The comonomer compositions which contain copolymerized vinyl silane units and are claimed according to the invention can be used to produce fiber non-wovens, strengthened after application and drying, which have good mechanical properties and solvent resistance. Compared with customary polymer compositions containing for example, N-methylolacrylamide units, they have not only the advantage of containing no formaldehyde, but also, due to the milder crosslinking conditions during the silanol condensation, the crosslinking occurs during film formation even at low temperatures of about 50° C.—milder drying conditions can be chosen during strengthening of the non-wovens, which reduces the discoloration of the non-wovens, which is undesirable in practice caused by the high thermal load which is customary for crosslinking and drying.

The binders can be applied to the non-wovens in a manner which is known per se, by impregnation, foam impregnation, spraying, padding or printing. After squeezing out the binder, the impregnated non-woven is dried at about 100 to about 150° C. The binder content in the dried and conditioned non-woven is generally 20–40 % by weight.

EXAMPLE 1

Determination of the degree of crosslinking of the conditioned films

The conditioned films are heated for 6 hours in refluxing ethyl acetate. The ethyl acetate is then evaporated, and the residue remaining is weighted.

DEGREE OF CROSSLINKING

Proportion of the insoluble residue, relative to the total sample weight in ethyl acetate

| Copolymers | Degree of Crosslinking |
|---|---|
| 96% of VAc<br>4% of NMA | 92% |
| 98% of VAc<br>2% of ViSi | 96% |
| 96% of VAc<br>4% of ViSi | 98.5% |
| 98% of VAc<br>1% of NMA<br>1% of ViSi | 96% |

VAc: vinyl acetate
NMA: N-methylolacrylamide
ViSi: vinyl trimethoxysilane

EXAMPLE 2

Solvent resistance of the crosslinking binders

Cellulose and polyester non-wovens are strengthened using dispersions containing the copolymers described below. The amount of binder applied is 30% by weight, relative to the total weight of fibers and binder. The maximum tensile forces (N) are determined in the dry and wet state in water and perchloroethylene.

| | Example 2 | | | | | | | |
|---|---|---|---|---|---|---|---|---|
| | Cellulose non-woven | | | | Polyester non-woven | | | |
| Copolymer composition | Original | 1 min. $H_2O$ | Dry | Wet | Original | 1 min. $H_2O$ | Dry | Wet |
| Hard binder systems | | | | | | | | |
| VAc 96%<br>NMA 4% | 17 | 7 | 17 | 8 | 14 | 11 | 16 | 7 |
| VAc 98%<br>NMA 1%<br>ViSi 1% | 20 | 8 | 17 | 8 | 12 | 8 | 16 | 7 |
| VAc 97%<br>HEA 1%<br>ViSi 2% | 14 | 6 | 17 | 7 | 11 | 7 | 14 | 7 |
| Soft binder systems | | | | | | | | |
| VAc 71%<br>E 25%<br>NMA 4% | 13 | 8 | 11 | 2 | 15 | 11 | 14 | 1.5 |
| VAc 83%<br>E 15%<br>ViSi 2% | 13 | 6 | 13 | 2 | 14 | 9 | 14 | 1.5 |

E = ethylene
HEA = hydroxyethyl acrylate

I claim:

1. A process for strengthening a textile fiber structure which comprises:
   (1) applying to said textile fiber structure from about 20–40 % of a self-crosslinking vinyl ester copolymer aqueous dispersion, based on the weight of copolymer and textile fiber structure, said dispersion having a reduced formaldehyde content or containing no formaldehyde for strengthening textile fiber structures, and comprised of:
      (a) 40–99% by weight of vinyl esters of branched or linear carboxylic acids having 1 to 12 carbon atoms,
      (b) 1–6% by weight of vinyltrialkoxysilanes and/or alkylvinyldialkoxysilanes containing branched or linear alkyl or alkoxy radicals having 1 to 4 carbon atoms,
      (c) 0–40% by weight of ethylene,
      (d) 0–10% by weight of ethylenically unsaturated, hydroxyalkyl-functional compounds,
      (e) 0–10% by weight of ethylenically unsaturated carboxylic acids,
      (f) 0–5% by weight of amides, N-alkylamides and/or N-alkoxyalkylamides of ethylenically unsaturated carboxylic acis, and
      (g) 0–1% by weight of ethylenically polyunsaturated compounds, and
   (2) crosslinking the copolymer under conditions suitable for film formation.

2. A process for strengthening a textile fiber structure which comprises:
   (1) applying to said textile fiber structure from about 20–40% self-crosslinking vinyl ester copolymer aqueous dispersion, based on the weight of copolymer and textile fiber structure said dispersion containing no formaldehyde for strengthening textile fiber structures, and comprised of:
      (a) 40–99% by weight of vinyl esters of branched or linear carboxylic acids having 1 to 12 carbon atoms,
      (b) 1–6% by weight of vinyltrialkoxysilanes and/or alkylvinyldialkoxysilanes containing branched or linear alkyl or alkoxy radicals having 1 to 4 carbon atoms,
      (c) 0–40% by weight of ethylene,
      (d) 0–10% by weight of ethylenically unsaturated, hyudroxyalkyl-functional compounds,
      (e) 0–10% by weight of ethylenically unsaturated carboxylic acids, and
      (f) 0–1% by weight of ethylenically polyunsaturated compounds, and
   (2) crosslinking the copolymer under conditions suitable for film formation.

3. The process of claim 1, wherein the copolymer is crosslinked by heating to a temperature of from about 50 to about 150° C.

4. The process of claim 2, wherein the copolymer is crosslinked by heating to a temperature of from about 50 to 150° C.

* * * * *